US011197098B2

(12) United States Patent
Liu et al.

(10) Patent No.: US 11,197,098 B2
(45) Date of Patent: Dec. 7, 2021

(54) SPEAKER

(71) Applicant: AAC Technologies Pte. Ltd., Singapore (SG)

(72) Inventors: Xiaodong Liu, Shenzhen (CN); Long Zhang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 131 days.

(21) Appl. No.: 16/706,740

(22) Filed: Dec. 7, 2019

(65) Prior Publication Data

US 2020/0213748 A1 Jul. 2, 2020

(30) Foreign Application Priority Data

Dec. 29, 2018 (CN) ..... 201822277486.X

(51) Int. Cl.

| | |
|---|---|
| ***H04R 9/02*** | (2006.01) |
| ***H04R 1/02*** | (2006.01) |
| ***H04R 9/06*** | (2006.01) |

(52) U.S. Cl.

CPC ..... *H04R 9/025* (2013.01); *H04R 1/026* (2013.01); *H04R 9/06* (2013.01); *H04R 2209/041* (2013.01)

(58) Field of Classification Search

CPC combination set(s) only.
See application file for complete search history.

(56) References Cited

U.S. PATENT DOCUMENTS

| | | | | |
|---|---|---|---|---|
| 10,728,672 | B2 * | 7/2020 | Kim | H04R 9/045 |
| 2004/0070294 | A1 * | 4/2004 | Hanada | H04R 9/047 310/81 |
| 2016/0227326 | A1 * | 8/2016 | Mao | H04R 9/066 |
| 2016/0381462 | A1 * | 12/2016 | Wang | H04R 9/025 381/398 |

FOREIGN PATENT DOCUMENTS

| | | |
|---|---|---|
| CN | 206341118 B1 | 7/2017 |
| CN | 207560323 B1 | 6/2018 |
| CN | 109889965 A1 | 6/2019 |

OTHER PUBLICATIONS

PCT search report dated Dec. 30, 2019 by SIPO in related PCT Patent Application No. PCT/CN2019/110612 (4 Pages).

* cited by examiner

*Primary Examiner* — Duc Nguyen
*Assistant Examiner* — Assad Mohammed
(74) *Attorney, Agent, or Firm* — W&G Law Group

(57) ABSTRACT

The present invention discloses a speaker having a frame, a vibrating system and a magnetic circuit system. The vibrating system has a vibrating diaphragm, a voice coil for driving the vibrating diaphragm, and an elastic supporting assembly fixed on the frame and connected to the voice coil. The magnetic circuit system has a main magnet, a secondary magnet spaced on two opposite sides of the main magnet, a magnetic plate stacked on the secondary magnet and spaced away from the elastic supporting assembly, and an auxiliary magnet fixed on the magnetic plate and spaced away from the main magnet. The elastic supporting assembly is positioned on the other two opposite sides of the main magnet. The auxiliary magnetic located close to the vibrating diaphragm and facing to the elastic supporting assembly. The speaker of the present invention has advantages of good reliability and excellent acoustic performance.

7 Claims, 3 Drawing Sheets

SPEAKER

FIELD OF THE PRESENT INVENTION

The present invention relates electro acoustic field, and more particularly to a speaker applied to a portable electronic product.

DESCRIPTION OF RELATED ART

With the advent of the mobile Internet era, the number of smart mobile devices is continuously increasing. Among numerous mobile devices, mobile phones are undoubtedly the most common and portable mobile terminal devices. A speaker for playing sound is widely applied to smart mobile devices, such as mobile phone. A vibrating system and a magnetic circuit system applied in the speaker are directly related to the sound quality of the speaker.

In the related art, a vibrating system of a speaker includes a diaphragm fixed on a frame and used for vibrating to generate sound, a voice coil attached to the vibrating diaphragm, an elastic supporting assembly supported the voice coil at an end away from the vibrating diaphragm and used for enhancing the horizontal stability of the voice coil. The magnetic circuit system comprises a yoke fixed on the frame, a main magnet fixed on the yoke, a secondary magnet located on two opposite sides of the main magnet and spaced from the main magnet to form a magnetic gap, and a magnetic plate stacked on the secondary magnet. The elastic supporting assembly is two-piece type and located on the other two opposite sides of the main magnet.

However, in the present speaker, gaps between the part of the magnetic plate facing to the elastic supporting assembly and the voice coil is too large, so that the space is not effectively utilized, thereby limiting the acoustic performance of the speaker.

Therefore, it is necessary to provide a new speaker which can overcome the above-mentioned problems.

BRIEF DESCRIPTION OF THE DRAWINGS

The embodiment of the present invention will be more clearly understood from the following drawings. It is obvious that the following described drawings are only some embodiments of the disclosure. For the person skilled in the art, he can achieve the other drawings from these drawings without any creative work.

DETAILED DESCRIPTION OF THE EXEMPLARY EMBODIMENT

The technical solution in the embodiments of the invention will be clearly and completely described by combining with the drawings in the embodiments of the disclosure. Apparently, the described embodiments are only parts of the embodiments of the invention, but not all of the embodiments. Based on these embodiments, all the other embodiments that the person skilled in the art can achieve without making creative work, are belong to the scope of protection of the disclosure.

Figure 1:
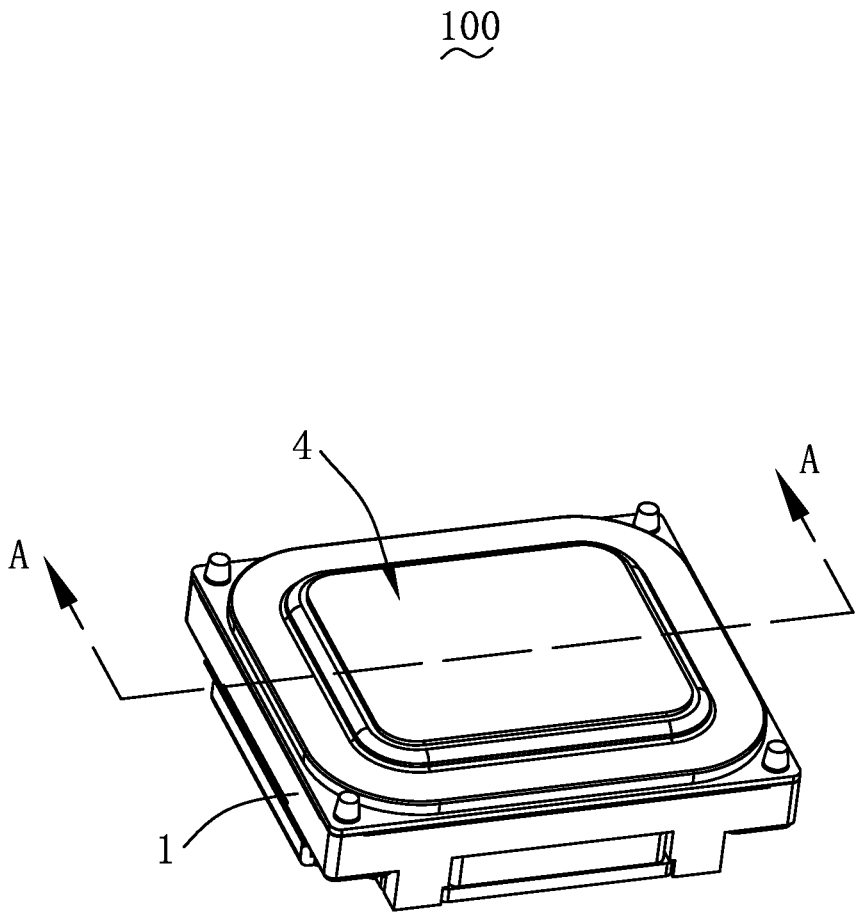
FIG. 1 is an isometric view of a speaker according to the present invention.
Figure 2:
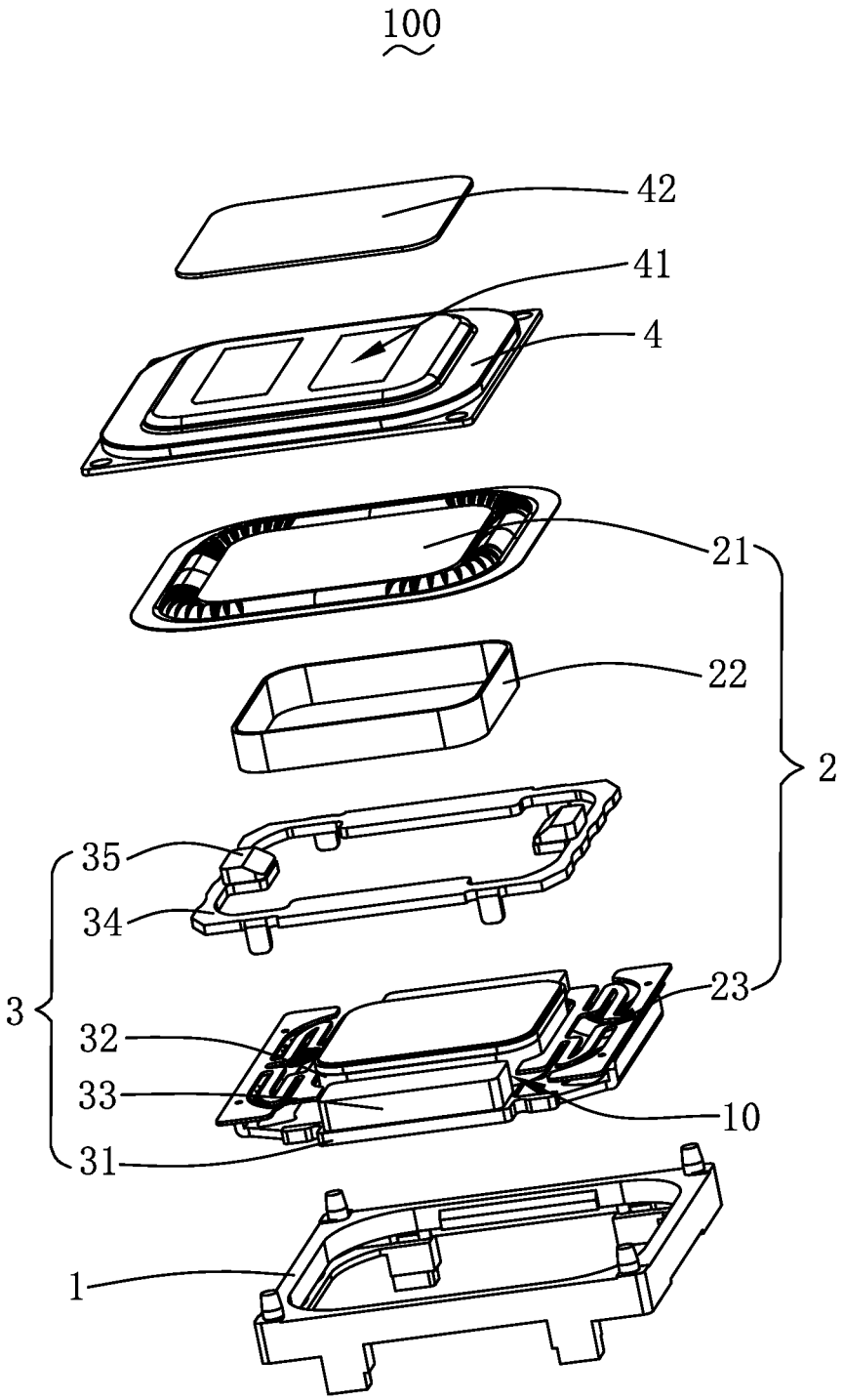
FIG. 2 is a part isometric and exploded view of the speaker in FIG. 1 according to the present invention.
Figure 3:
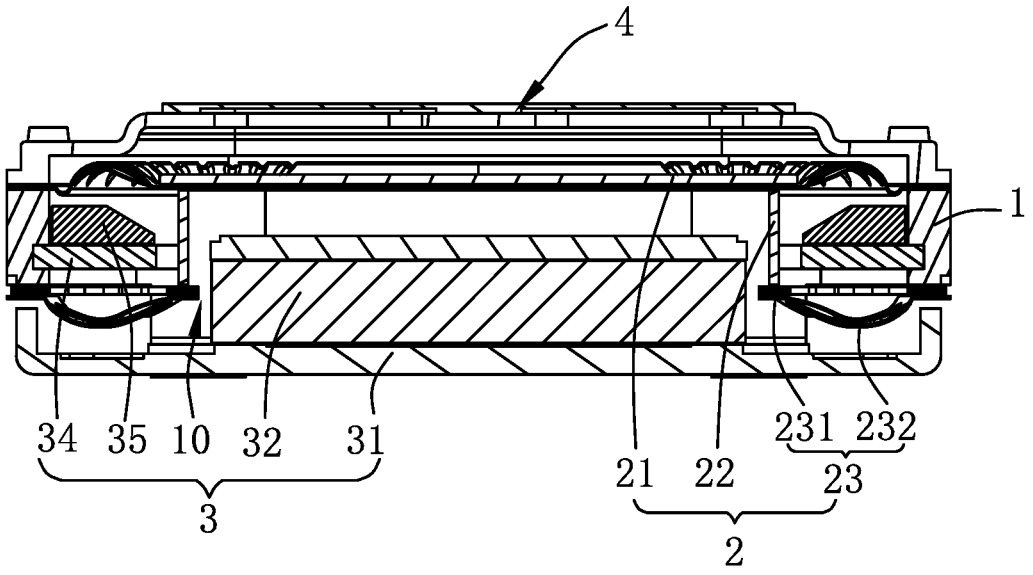
FIG. 3 is a cross-sectional view of the speaker taken along a line A-A in FIG. 1.

Referring to FIGS. 1-3, the present invention discloses a speaker 100 which includes a frame 1, a vibrating system 2 and a magnetic circuit system 3 both accommodated in the frame 1, and a front cover 4. The magnetic circuit system 3 is provided with a magnetic gap 10 for driving the vibrating system 2 to generate sound.

The vibrating system 2 includes a vibrating diaphragm 21 fixed on the frame 1, a voice coil 22 fixed on the vibrating diaphragm 21 and inserted into the magnetic gap 10 for driving the vibrating diaphragm 21 to generate sound, and an elastic supporting assembly 23 fixed on the frame 1 and connected to the voice coil 22 at an end away from the vibrating diaphragm 21.

In this embodiment, the elastic supporting assembly 23 includes an elastic member 231 and an auxiliary vibrating diaphragm 232 connected to the elastic member 231.

One end of the elastic member 231 is fixed on the frame 1, the other end is connected to the voice coil 22 at an end away from the vibrating diaphragm 21. The auxiliary vibrating diaphragm 232 is connected to the elastic member 231, e.g., the auxiliary vibrating diaphragm 232 is fixedly bonded with the elastic member 231 at a side away from the vibrating diaphragm 21. The voice coil 22 at the end away from the diaphragm 21 is connected with the frame 1 through the elastic supporting assembly 23. The above structure is used on the one hand for enhancing the vibration effect of the diaphragm 21 to improve the acoustic performance of the speaker 100, and on the other hand for balancing the sway of the vibrating system 2 to improve the stability of the speaker 100. It should be noted that the elastic supporting assembly 23 can include only one of the elastic member 231 or the auxiliary vibrating diaphragms 232, which is also feasible.

Preferably, the elastic supporting assembly 23 is a flexible circuit board, and the voice coil 22 is electrically connected to the elastic supporting assembly 23. The structure above is used on the one hand for improving the vibration intensity and restricting the sway of the vibrating system 2, and on the other hand for leading out the voice coil 22 to the external power, thus to avoid the risk that the voice coil leading wire is easily broken when it is led out to the external power by the voice coil leading wire.

The magnetic circuit system 3 comprises a yoke 31 fixed on the frame 1, a main magnet 32 fixed on the yoke 31, a secondary magnet 33 located on two opposite sides of the main magnet 32 and spaced away from the main magnet 32 to form the magnetic gap 10, a magnetic plate 34 in an annular shape stacked on the secondary magnet 33 and spaced away from the elastic supporting assembly 23, and an auxiliary magnet 35 fixed on the magnetic plate 34 and spaced away from the main magnet 32. An orthographic projection of the elastic supporting assembly 23 on the yoke 31 along a vibrating direction of the vibrating diaphragm 21, and an orthographic projection of the secondary magnet 33 on the yoke 31 along the vibrating direction of the vibrating diaphragm 21 at least do not overlap partially. An orthographic projection of the auxiliary magnet 35 on the yoke 31 along the vibrating direction of the diaphragm 21, and the orthographic projection of the secondary magnet 33 on the yoke 31 along the vibrating direction of the diaphragm 21 do not overlap each other.

In this embodiment, the elastic supporting assembly 23 is two-piece type 23 and positioned at the other two opposite sides of the main magnet 32. The auxiliary magnet 35 are located on the magnetic plate 34 at a side close to the vibrating diaphragm 21, and facing to the elastic supporting assembly 23. The elastic supporting assembly 23 is centrally symmetrical with respect to the main magnet 32 for ensuring the vibrating system 2 is stable and balanced.

That is, in this embodiment, the elastic supporting assembly 23 and the secondary magnet 33 are respectively located on different opposite sides of the main magnet 32, and are arranged to surround the main magnet 32.

In this embodiment, the main magnet 32 is rectangular. The secondary magnet 33 is positioned at two opposite sides along a longitudinal direction of the main magnet 32, the elastic supporting assembly 23 is located at two opposite sides along a lateral direction of the main magnet 32, and the auxiliary magnet 35 is located at two opposite sides along the lateral direction of the main magnet 32. This arrangement can greatly keep the structure volume of the magnetic circuit system 3 maximized, thus to enhance the strength of the magnetic field.

In the related art, the part of the magnetic plate 34 facing to the elastic supporting assembly 23 is avoided for the elastic supporting assembly 23 and no magnet structure is arranged thereof, so that there remains a large space being not effectively utilized from this part to the voice coil 22 and to the vibrating diaphragm 21, which limits the driving force of the magnetic circuit system 3, and thereby limits the acoustic performance of the sound emitting device 100. Therefore, in the embodiment of the present invention, the auxiliary magnet 35 is added at these parts to utilize the extra space, and the driving performance of the magnetic circuit system 3 is greatly improved, so that the speaker 100 has a better acoustics performance.

In the present embodiment, a magnetization direction of the main magnet 32 is the same as a magnetization direction of the auxiliary magnet 35, and their magnetization direction is parallel to the vibrating direction of the diaphragm 21. E.g., a magnetic pole of the auxiliary magnet 35 close to the diaphragm 21 is N pole, and a magnetic pole of the auxiliary magnet 35 close to the elastic supporting assembly 23 is S pole. The distribution of the magnetic poles of the main magnet 32 is identical to the same of the auxiliary magnet 35. Naturally, the magnetic poles can be reversed.

Alternatively, the main magnet 32 is magnetized along the vibrating direction of the diaphragm 21, and the auxiliary magnet 35 is magnetized along a direction perpendicular to the vibrating direction of the diaphragm 21. E.g., a magnetic pole of the auxiliary magnet 35 close to the main magnet 32 is S pole, and a magnetic pole of the auxiliary magnet 35 away from the main magnet 32 is N pole. A magnetic pole of the main magnet 32 close to the vibrating diaphragm 21 is N pole, and a magnetic pole of the main magnet 32 away from the vibrating diaphragm 21 is S pole, which is also feasible.

The magnetization direction of the auxiliary magnet 35 and the main magnet 32 improves the vibration symmetry of the speaker 100, that is, it improves the reliability of the speaker 100.

The front cover 4 is positioned on a side of the frame 1, which side is close to the diaphragm 21, and forms a sounding cavity surrounded together with the vibrating diaphragm 21. The front cover 4 is provided with a sound port 41 and a damping layer 42 covered on the sound port 41, which are used for achieving the adjustment of high frequency acoustic performance of the sound.

Compared with the related prior art, the speaker of the present invention includes a vibrating diaphragm, a voice coil fixed on the vibrating diaphragm for driving the vibrating diaphragm to vibrate, and an elastic supporting assembly connected to the voice coil at the end away from the diaphragm. The auxiliary magnet is added at the part of the magnetic plate facing to the elastic supporting assembly. The auxiliary magnet is two-piece type, and is located on opposite sides of the main magnet. The magnetization direction of the auxiliary magnet is parallel or perpendicular to the magnetization direction of the main magnet. Because of the above structure, the space between the part of the magnetic plate faces to the elastic supporting assembly and the vibrating diaphragm is fully utilized by arranging the auxiliary magnet hereof. Therefore the driving force of the magnetic circuit system is greatly improved, the acoustic performance of the speaker is effectively improved, the vibration symmetry of the speaker is improved, and the reliability becomes better.

The above is only the embodiment of the present invention, and it should be noted that those skilled in the art can still make improvements without departing from the inventive concepts, and these improvements are all belong to the protection scope of the present invention.

What is claimed is:

1. A speaker, comprising a frame, a vibrating system and a magnet circuit system with a magnetic gap both accommodated in the frame respectively, wherein, the vibrating system comprises a vibrating diaphragm fixed on the frame, a voice coil inserted into the magnetic gap for driving the vibrating diaphragm, and an elastic supporting assembly fixed on the frame and connected to the voice coil at an end away from the vibrating diaphragm;

the elastic supporting assembly includes an elastic member and an auxiliary vibrating diaphragm connected to the elastic member, wherein one end of the elastic member is fixed on the frame, and the other end of the elastic member is fixed on the voice coil at an end away from the vibrating diaphragm, the elastic member is a flexible circuit board, and the voice coil is electrically connected to the elastic member;

the magnetic circuit system comprises a yoke fixed on the frame, a main magnet fixed on the yoke, a secondary magnet located on two opposite sides of the main magnet and spaced away from the main magnet for forming the magnetic gap, and a magnetic plate stacked on the secondary magnet and spaced away from the elastic supporting assembly;

an orthographic projection of the elastic supporting assembly on the yoke along a vibrating direction of the diaphragm, and an orthographic projection of the secondary magnet on the yoke along the vibrating direction of the diaphragm at least do not overlap partially;

the magnetic plate is an annular shape; and the magnet circuit system further includes an auxiliary magnet fixed on the magnetic plate and spaced away from the main magnet; the auxiliary magnetic located on the magnetic plate at a side close to the vibrating diaphragm and facing to the elastic supporting assembly.

2. The speaker according to claim 1, wherein the main magnet and the auxiliary magnet have the same magnetization direction, and the magnetization direction is parallel to the vibrating direction of the diaphragm.

3. The speaker according to claim 2, wherein a magnetic pole of the auxiliary magnet close to the diaphragm is N pole, and a magnetic pole of the auxiliary magnet close to the elastic supporting assembly is S pole.

4. The speaker according to claim 1, wherein the main magnet is magnetized along the vibrating direction of the vibrating diaphragm, and the auxiliary magnet is magnetized along a direction perpendicular to the vibration of the vibrating diaphragm.

5. The speaker according to claim 4, wherein a magnetic pole of the auxiliary magnet close to the main magnet is S pole, and a magnetic pole of the auxiliary magnet away from the main magnet is N pole.

6. The speaker according to claim 1, where in the main magnet is rectangular, and the secondary magnet is positioned at two opposite sides along a longitudinal direction of the main magnet, and the elastic supporting assembly is located at two opposite sides along a lateral direction of the main magnet, the auxiliary magnet is located at two opposite sides along the lateral direction of the main magnet.

7. The speaker according to claim 1, wherein an orthographic projection of the auxiliary magnet on the yoke along the vibrating direction of the diaphragm, and the orthographic projection of the secondary magnet on the yoke along the vibrating direction of the vibrating diaphragm do not overlap each other.

* * * * *